US009709333B2

(12) United States Patent
Hill et al.

(10) Patent No.: US 9,709,333 B2
(45) Date of Patent: Jul. 18, 2017

(54) MULTIPURPOSE RACK FOR PROCESSING PARTS THROUGH MULTIPLE MANUFACTURING PROCESSES

(71) Applicant: FORD GLOBAL TECHNOLOGIES, LLC, Dearborn, MI (US)

(72) Inventors: David John Hill, Ann Arbor, MI (US); Steve Sparkes, Harrison Township, MI (US)

(73) Assignee: Ford Global Technologies LLC, Dearborn, MI (US)

( * ) Notice: Subject to any disclaimer, the term of this patent is extended or adjusted under 35 U.S.C. 154(b) by 277 days.

(21) Appl. No.: 14/266,903

(22) Filed: May 1, 2014

(65) Prior Publication Data

US 2015/0316323 A1 Nov. 5, 2015

(51) Int. Cl.

| | |
|---|---|
| ***B25B 1/20*** | (2006.01) |
| ***F27D 5/00*** | (2006.01) |
| ***B65D 19/44*** | (2006.01) |

(52) U.S. Cl.

CPC ..... *F27D 5/00* (2013.01); *B65D 19/44* (2013.01); *B65D 2519/00024* (2013.01); *B65D 2519/00059* (2013.01); *B65D 2519/0081* (2013.01); *B65D 2519/00094* (2013.01); *B65D 2519/0097* (2013.01); *B65D 2519/00233* (2013.01); *B65D 2519/00273* (2013.01); *B65D 2519/00293* (2013.01); *B65D 2519/00323* (2013.01); *B65D 2519/00333* (2013.01); *B65D 2519/00373* (2013.01); *B65D 2519/00701* (2013.01); *B65D 2585/6882* (2013.01)

(58) Field of Classification Search

USPC ..... 269/37

See application file for complete search history.

(56) References Cited

U.S. PATENT DOCUMENTS

| | | | | |
|---|---|---|---|---|
| 1,453,005 | A * | 4/1923 | Considine | B65D 7/14 217/36 |
| 2,276,432 | A * | 3/1942 | Stucki | A01K 1/0017 119/59 |
| 4,317,607 | A * | 3/1982 | Gomolka | F25D 13/04 312/236 |
| 4,492,504 | A * | 1/1985 | Hainsworth | B65G 1/0421 414/273 |
| 4,685,095 | A * | 8/1987 | Rudy | G11B 17/225 369/30.43 |
| 4,762,236 | A * | 8/1988 | Jackle, III | A47F 1/126 211/59.3 |
| 4,874,281 | A * | 10/1989 | Bergerioux | B07C 3/02 186/55 |

(Continued)

FOREIGN PATENT DOCUMENTS

| | | | | |
|---|---|---|---|---|
| NL | WO 8602610 A1 * | 5/1986 | | A47F 5/135 |

*Primary Examiner* — Alvin Grant

(74) *Attorney, Agent, or Firm* — Raymond Coppiellie; King & Schickli PLLC

(57) ABSTRACT

A rack for simultaneously processing a plurality of parts includes a frame, a plurality of defined locations on the frame for receiving and holding individual parts for processing and a latching assembly for locking the parts to the frame in the defined locations. The rack further includes a security feature for indicating if the latching assembly is opened after the parts have been loaded and locked into the defined locations on the frame.

16 Claims, 13 Drawing Sheets

(56) References Cited

U.S. PATENT DOCUMENTS 5,192,176 A * 3/1993 Roberts ..... B60P 1/6481 105/371
5,209,626 A * 5/1993 Lichti, Sr. ..... B65G 1/127 198/364
5,238,351 A * 8/1993 Lichti, Sr. ..... B65G 1/127 198/435
5,282,712 A * 2/1994 Lichti, Sr. ..... B65G 1/127 198/867.13
5,611,270 A * 3/1997 Harrington ..... B30B 9/323 100/102
5,745,366 A * 4/1998 Higham ..... G07F 17/0092 312/215
5,905,653 A * 5/1999 Higham ..... G07F 17/0092 312/215
6,535,682 B1 * 3/2003 Puetz ..... G02B 6/4452 385/135
6,760,531 B1 * 7/2004 Solheid ..... G02B 6/4452 385/135
6,850,208 B1 * 2/2005 Ferrante ..... G06Q 10/087 345/1.1
7,227,715 B2 * 6/2007 Woodruff ..... G11B 15/6825 360/96.4
7,265,938 B2 * 9/2007 Armagost ..... G11B 15/6835 360/96.4
7,278,813 B2 * 10/2007 Davis ..... H01L 21/67769 414/416.03
7,293,666 B2 * 11/2007 Mattlin ..... G06F 1/181 211/189
7,359,142 B2 * 4/2008 Heineman ..... G11B 15/6835 360/92.1
7,472,970 B2 * 1/2009 Bergesch ..... G06F 1/181 211/26
7,508,621 B2 * 3/2009 Pollard ..... G11B 15/6835 360/92.1
7,628,281 B2 * 12/2009 Sopel ..... B60P 7/15 211/7
7,893,356 B2 * 2/2011 Garza ..... H02G 3/30 174/100
7,948,448 B2 * 5/2011 Hutchinson ..... G09B 5/067 345/1.1
8,225,989 B1 * 7/2012 Turocy ..... G07D 11/0048 235/379
8,229,802 B2 * 7/2012 Henry ..... G06Q 10/087 705/28
8,336,767 B1 * 12/2012 Graef ..... G07D 11/0048 235/379
8,366,109 B2 * 2/2013 Soltys ..... A63F 1/10 273/149 P
8,377,360 B2 * 2/2013 Nye ..... B41J 3/4073 264/308
8,453,924 B1 * 6/2013 Turocy ..... G06Q 40/02 235/379
8,469,228 B2 * 6/2013 Adams ..... G07F 7/0609 211/129.1
8,558,113 B2 * 10/2013 Krietzman ..... H02G 3/0475 174/100
8,764,358 B2 * 7/2014 Bose ..... 410/32
9,132,873 B1 * 9/2015 Laurence ..... B62D 65/024
2004/0016708 A1 * 1/2004 Rafferty ..... H05K 7/1492 211/26
2008/0151524 A1 * 6/2008 Kelly ..... H04Q 1/064 361/826

* cited by examiner

MULTIPURPOSE RACK FOR PROCESSING PARTS THROUGH MULTIPLE MANUFACTURING PROCESSES

TECHNICAL FIELD

This document relates generally to racks for holding and processing a group of parts and, more particularly, to a multipurpose rack for processing parts through multiple manufacturing processes.

BACKGROUND

Parts are often subjected to a number of different manufacturing processes before being assembled into a final product. For example, roof rails and other parts for a pickup truck are typically subjected to a heat treatment to increase strength and a chemical pretreatment to prepare the parts for receiving adhesive used to bond vehicle components together later in the assembly process.

In the past this has been done by loading parts onto a mild steel rack and then subjecting them as a group to heat treatment in an oven. Following heat treatment the parts have been unloaded from the mild steel rack and then reloaded onto a stainless steel rack for purposes of chemical pretreatment. Following chemical pretreatment the parts have been unloaded from the stainless steel rack and reloaded onto a clean rack for transport or transfer to the assembly area.

This document relates to a new multipurpose rack which can properly hold a group of parts for heat treatment, chemical pretreatment and transfer to an assembly area thereby eliminating the re-racking steps. Advantageously the multipurpose rack described in this document lowers production costs by eliminating re-racking, minimalizing the part handling, reducing damage caused by excessive part handling and improving the traceability of parts as they are processed. Further, it reduces the number of racks required for part processing thereby increasing useable floor space at the manufacturing plant. Floor space for the processing equipment is also greatly reduced as we can process multiple parts simultaneously, i.e. 48 and 68 depending on the rack used. Previous methods would have required one part at a time greatly increasing the foot print of the machine that would perform this process.

SUMMARY

In accordance with the purposes and benefits described herein, a rack is provided for simultaneously processing a plurality of parts. The rack may be broadly described as comprising a frame, a plurality of defined locations on the frame for receiving and holding individual parts for processing and a latching assembly for locking the parts to the frame in the defined locations. The rack further includes a security feature for indicating if the latching assembly is opened after the parts have been loaded and locked into the defined locations on the frame. In addition the rack includes a unique ID code to identify the rack and the parts loaded and locked into the defined locations on the frame throughout the manufacturing process.

In one possible embodiment the frame includes a first post, a first upright, a second post, a second upright, a first support arm and a second support arm. The first support arm extends between the first post and the first upright and the second support arm extends between the second post and the second upright.

The first support arm includes a first plurality of part locating elements and the second support arm includes a second plurality of part locating elements. In one possible embodiment the first and second plurality of part locating elements comprise a plurality of spaced retaining grooves or scallops provided in the first and second support arms. In one possible embodiment, the frame further includes a first end plate having a third plurality of part locating elements. The third plurality of part locating elements comprise tabs received within open ends of the plurality of parts. Accordingly, the first, second and third locating elements locate a first group of parts in the defined locations on the frame so that no one part touches another part. This ensures that each part receives proper heat treatment and chemical pretreatment during processing.

In one possible embodiment the rack further includes a first retaining arm carried on the first post and displaceable between a part loading position and a part securing position. In one possible embodiment the rack further includes a second retaining arm carried on the second post and displaceable between a part loading position and a part securing position. The first group of parts is captured in the defined locations (a) between the first retaining arm and the first support arm and (b) between the second retaining arm and the second support arm when the first and second retaining arms are in the part securing positions.

In one possible embodiment the first retaining arm includes a fourth plurality of locating elements and the second retaining arm includes a fifth plurality of locating elements. Further, the frame includes a second endplate having a sixth plurality of locating elements. Together the fourth, fifth and sixth locating elements locate a second group of parts in defined locations on the frame so that no one part touches another part.

In still another possible embodiment the frame includes a third retaining arm connected to the first post and a fourth retaining arm connected to the second post. The third and fourth retaining arms are both displaceable between part loading and part securing positions. In this embodiment the second group of parts is captured in defined locations (a) between the third retaining arm and the first retaining arm and (b) between the fourth retaining arm and second retaining arm when the third and fourth retaining arms are in the part securing positions.

In one possible embodiment the latching assembly includes a first latching bar and a second latching bar. The first and second latching bars are displaceable between part loading and part locking positions. When the first and second latching bars are in the locking position, the first latching bar engages and closes end openings between the first support arm, the first retaining arm and the third retaining arm and the second latching bar engages and closes end openings between the second support arm, the second retaining arm and the fourth retaining arm. The latching assembly may also include (a) a first clevis pin for securing the first latching bar to the frame in the locking position and (b) a second clevis pin for securing the second latching bar to the frame in the locking position. Further the security feature may include (a) a first security tab connected to the first clevis pin so that the first clevis pin is captured in the frame by the first security tab and (b) a second security tab connected to the second clevis pin so that the second clevis pin is captured in the frame by the second security tab. In one possible embodiment the first and second security tabs are frangible and must be broken to pull the first and second clevis pins from the frame and allow displacement of the (a)

first and second latching bars and (b) first, second, third and fourth retaining arms to allow removal of any parts from the rack.

In the following description, there is shown and described several preferred embodiments of the rack. As it should be realized, the rack is capable of still other, different embodiments and its several details are capable of modification in various, obvious aspects all without departing from the rack as set forth and described in the following claims. Accordingly, the drawings and descriptions should be regarded as illustrative in nature and not as restrictive.

BRIEF DESCRIPTION OF THE DRAWING FIGURES

The accompanying drawing figures incorporated herein and forming a part of the specification, illustrate several aspects of the rack and together with the description serve to explain certain principles thereof. In the drawings.

Figure 2:
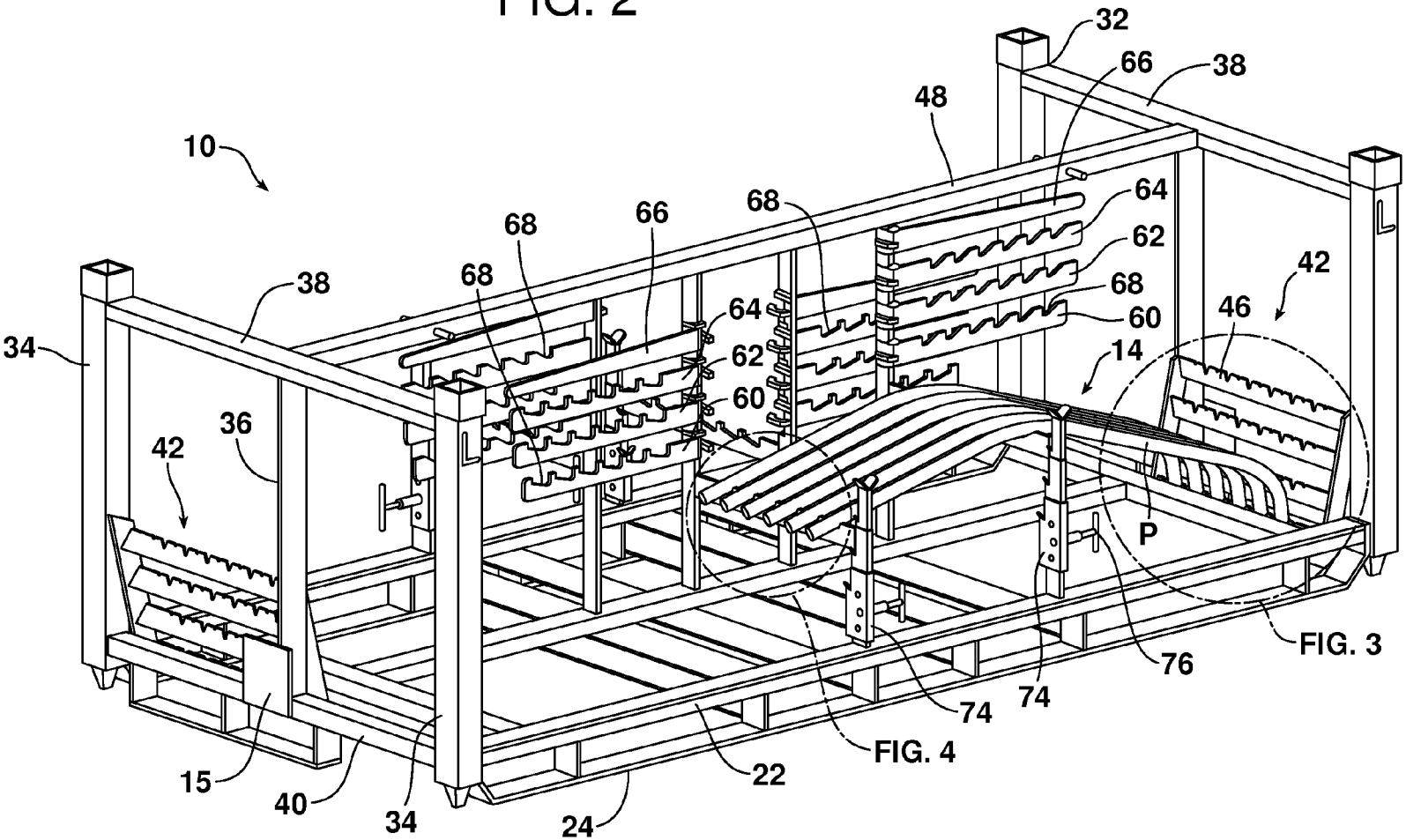
FIG. 2 is a perspective view similar to FIG. 1 but showing the first row of parts loaded onto the rack.
Figure 6:
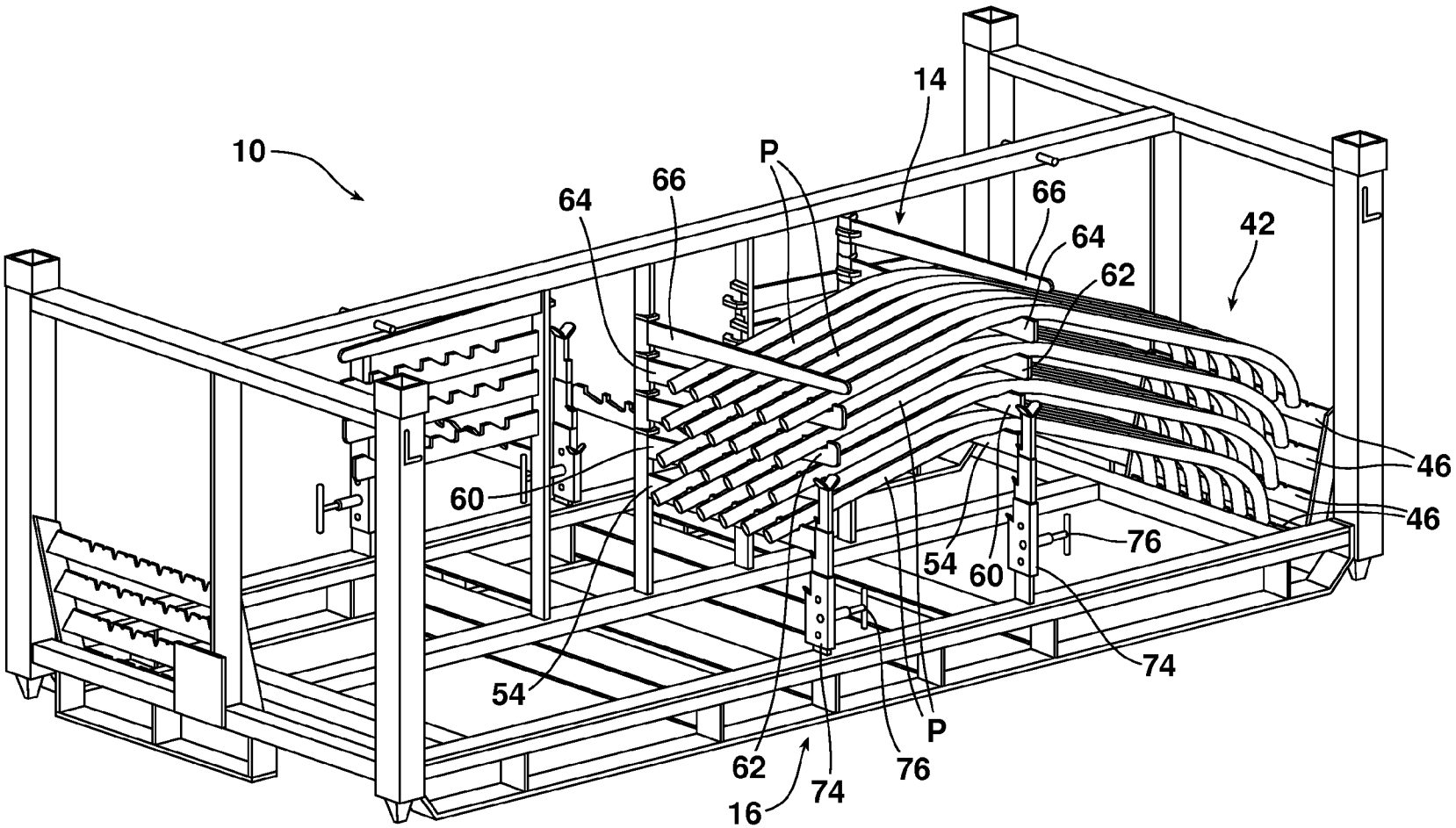

FIG. 6 is a perspective view similar to FIG. 2 showing half the rack loaded with 24 parts (roof rails) each received and held by (a) the two support arms, (b) the two lowermost retaining arms, (c) the next two retaining arms above the lowermost retaining arms and (d) the next two pivoting arms above those. The top two pivoting retaining arms are shown overlying the top row of roof rails. The stepped latching bars are shown in the lowermost, part loading position.

Figure 7:
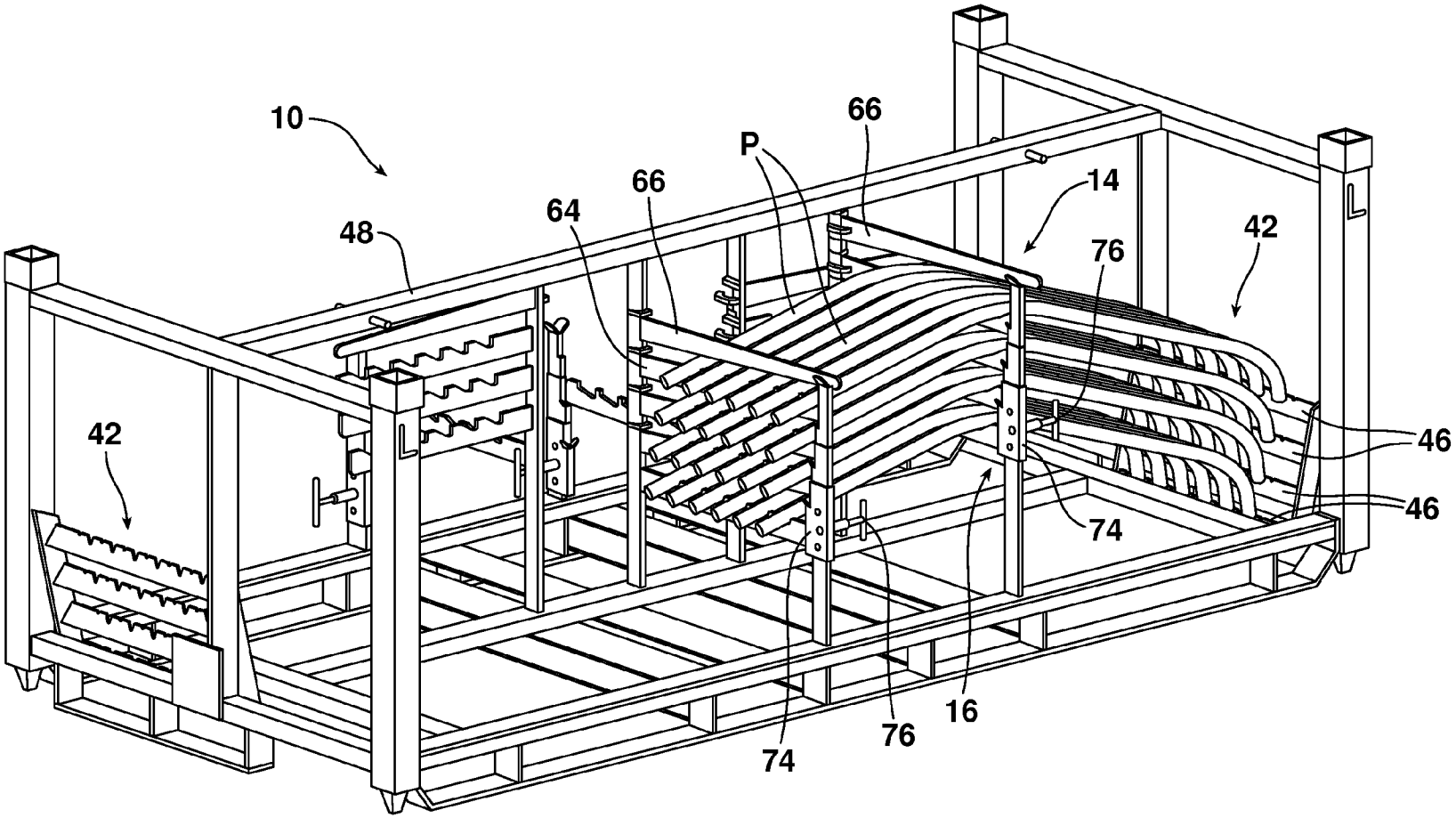

FIG. 7 is a view very similar to FIG. 6 but showing the stepped latching bars raised into the parts securing position so that the stepped latching bars engage and close the end of each pivoting retaining arm thereby latching the parts in place on the rack.

Figure 8:
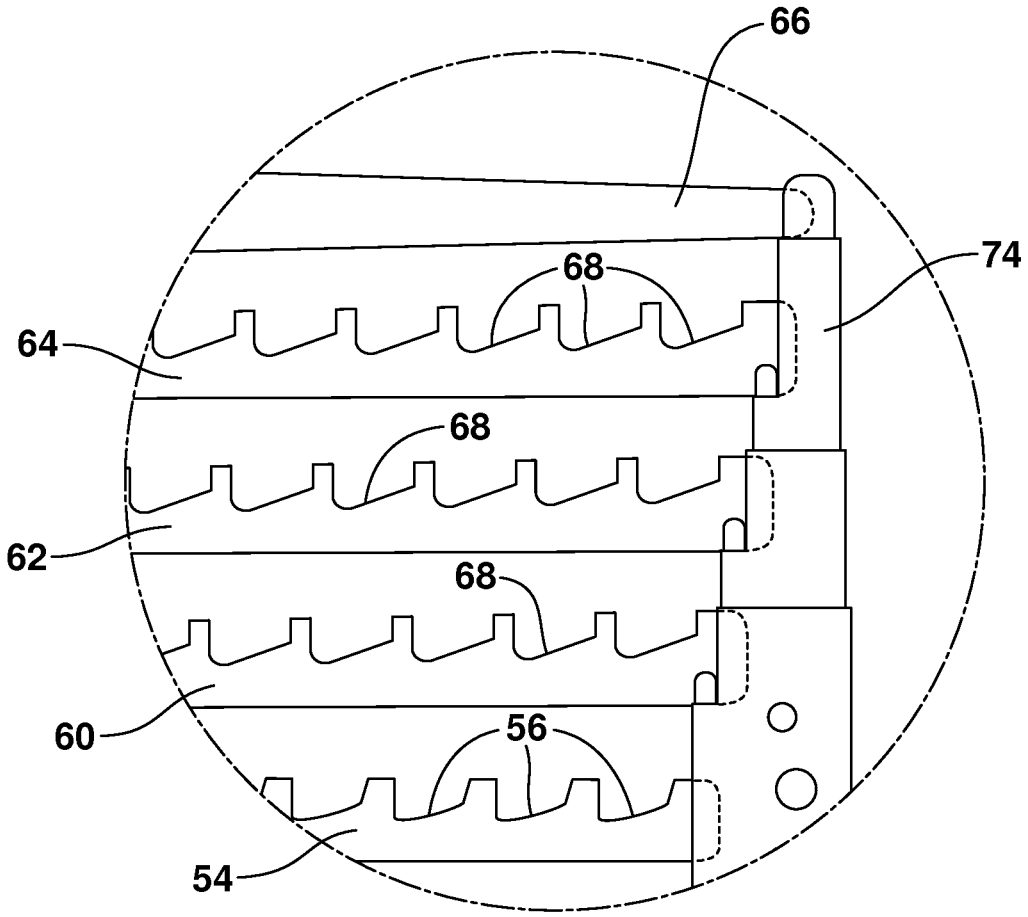

FIG. 8 is a detailed side elevational view clearly showing the different lengths of the retaining arms and how the stepped latching bar engages and captures the end of each arm when raised into the securing position.

Figure 9:
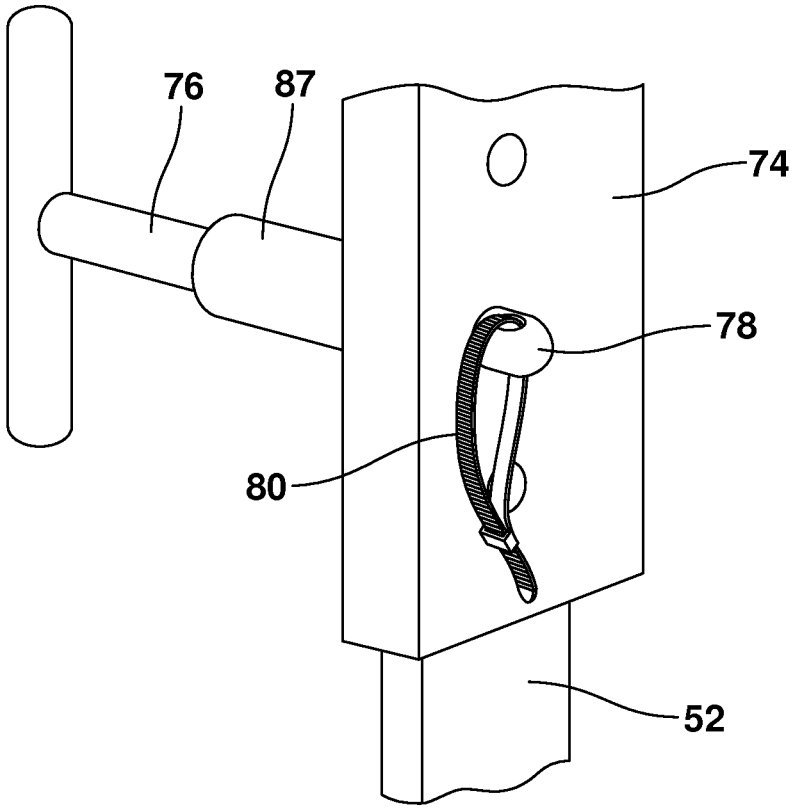

FIG. 9 is a detailed perspective view illustrating the sacrificial security tab received in one of the captive clevis pins which locks a latching bar in the parts securing position.

Figure 10:
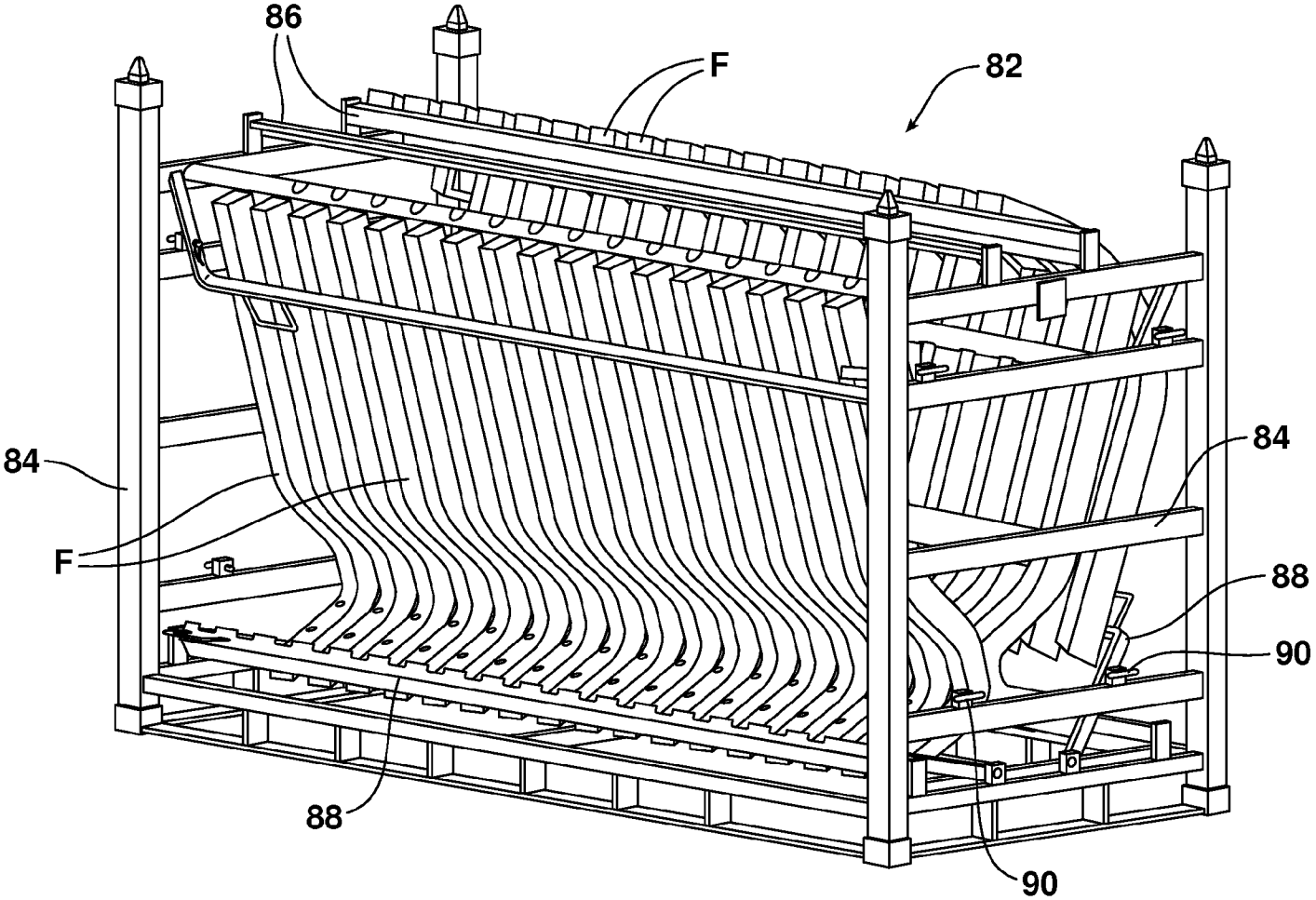

FIG. 10 is a perspective view illustrating an alternative rack embodiment loaded with a group of parts in the form of front rails.

Figure 11:
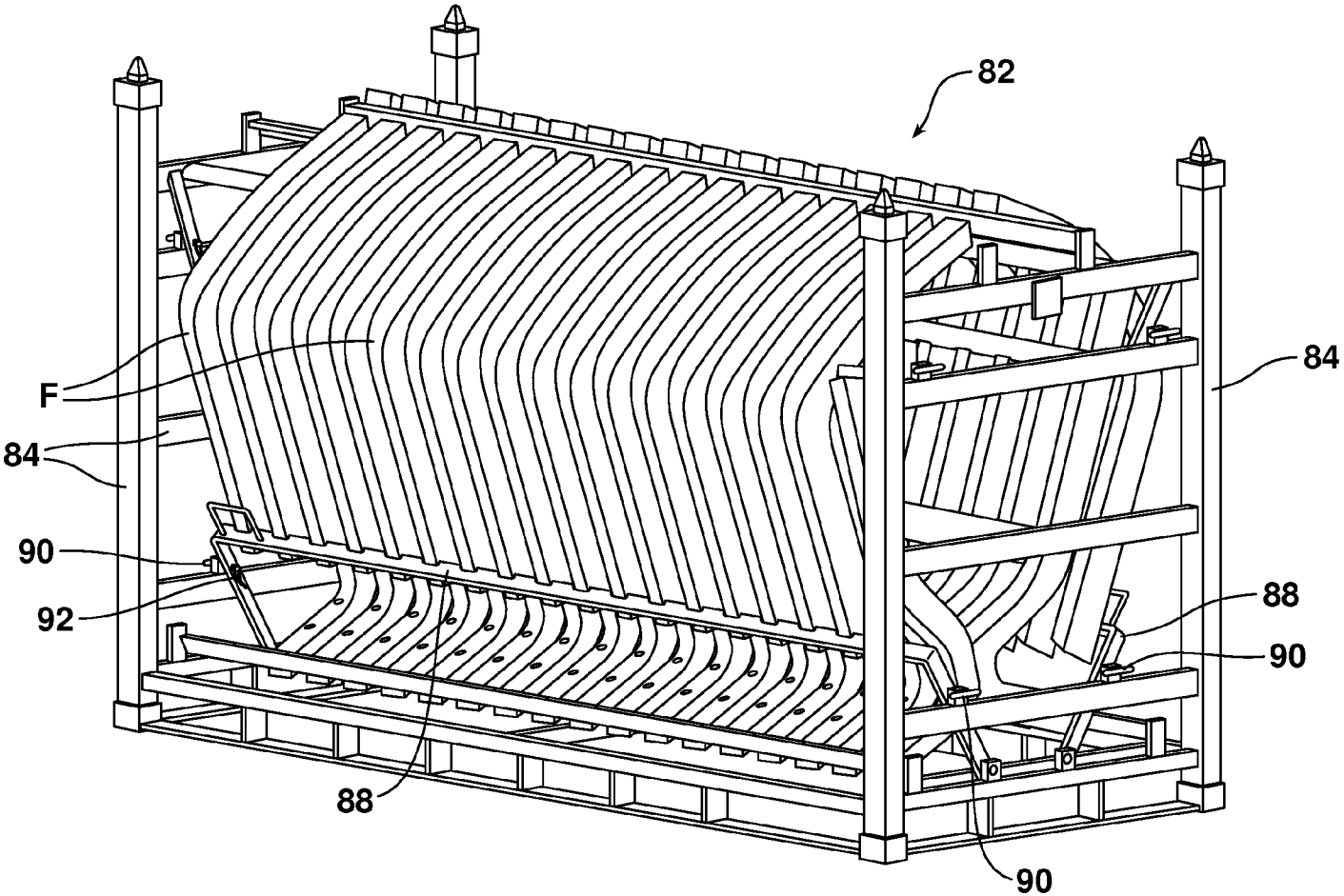

FIG. 11 illustrates the latching bar of the alternative embodiment including the clevis pin and the security tab.

Figure 12:
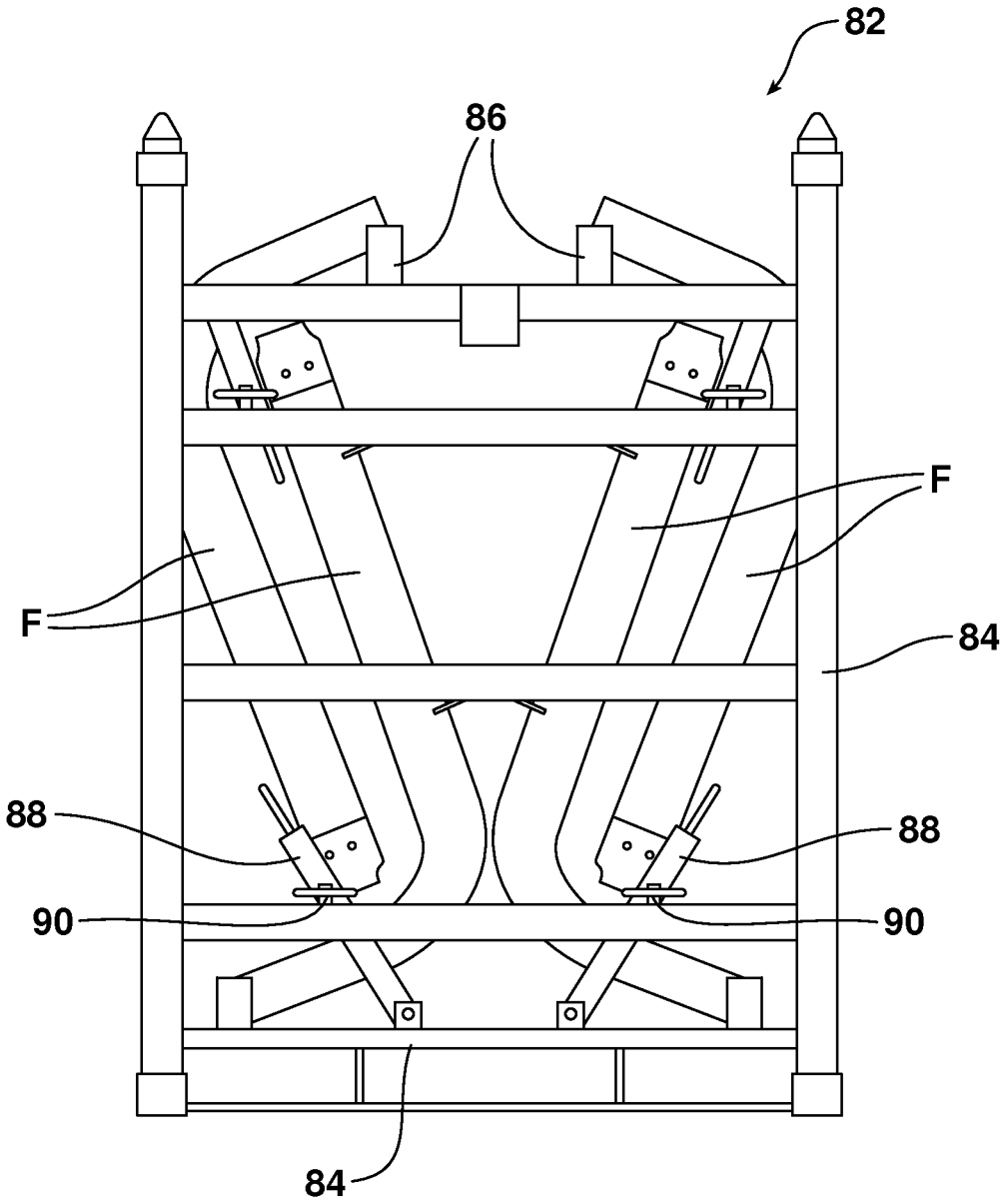

FIG. 12 is an end view of the fully loaded alternative embodiment of the rack illustrated in FIGS. 10 and 11.

Figure 13:
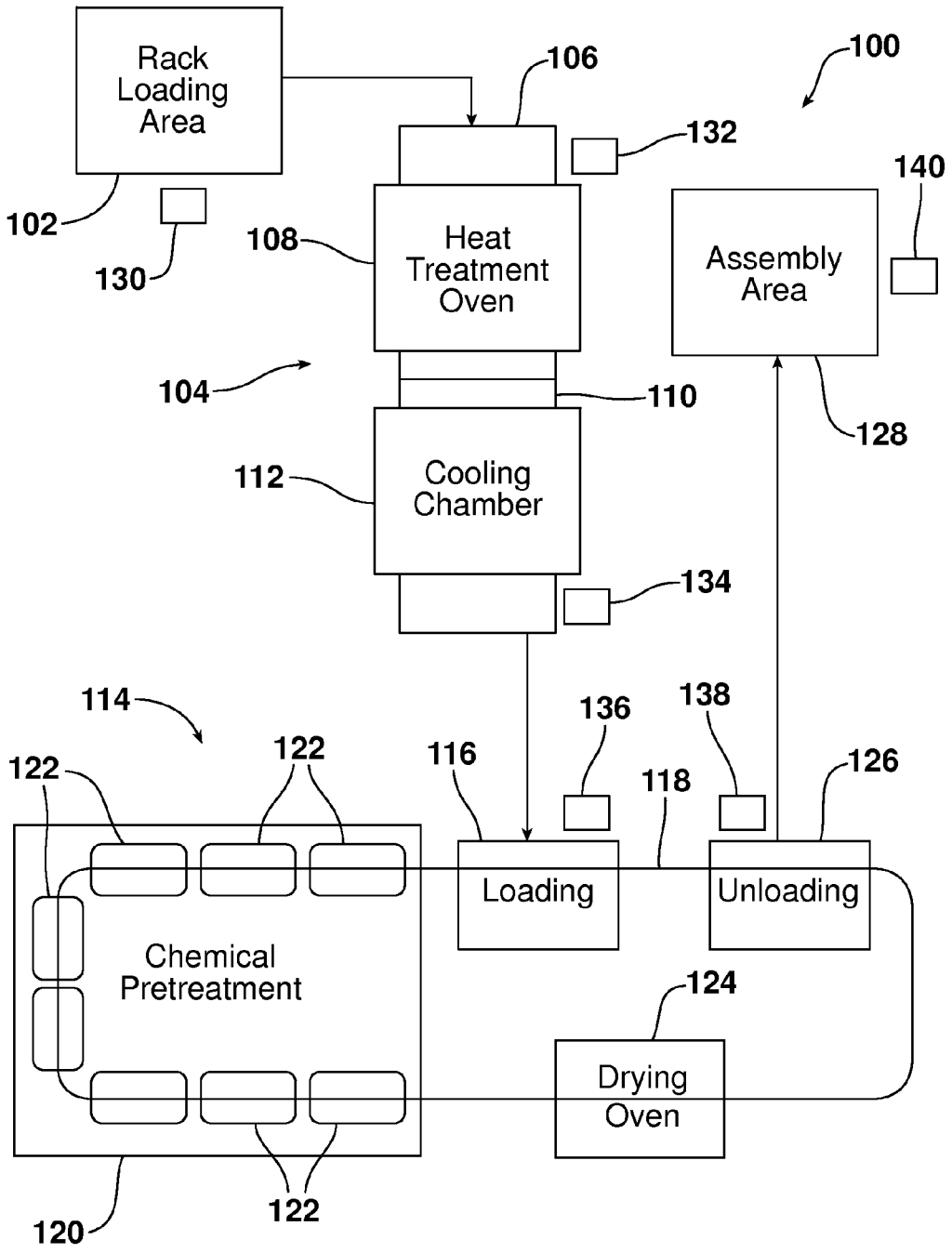

FIG. 13 is a schematical block diagram of a manufacturing plant floor.

Reference will now be made in detail to the present preferred embodiments of the rack, examples of which are illustrated in the accompanying drawing figures.

DETAILED DESCRIPTION

Reference is now made to FIGS. 1-9 generally illustrating a multipurpose rack 10 for simultaneously processing a plurality of parts P. The rack 10 comprises a frame 12, a plurality of defined locations 14 on the frame for receiving and holding individual parts P for processing and a latching assembly 16 for locking the parts to the frame in the defined locations. In one useful embodiment the rack 10 is made from stainless steel such as 316L stainless steel and the frame 12 utilizes open channel materials rather than closed boxed sections in order to improve drainage. The rack 10 is capable of accommodating parts P of differing lengths such as A-pillar roof rails having a length depending upon cab style: regular, extended and crew cab. As will be appreciated from reviewing the following description, the rack 10 is mirrored down the centerline (defined by center rail 28 and center beam 48) thereof to aid balance through improved weight distribution and improved ergonomics for manually loading parts into the rack while utilizing minimized reach. As should further be appreciated there is a large open channel along the centerline to improve air and fluid flow which, in turn, reduces the flow path length to the parts located in the center of the rack.

As illustrated, the frame 12 includes a base, generally designated by reference numeral 20, comprising two side rails 22, two skids 24 connected to the side rails, two end rails 26 and one center rail 28. A "palate" is formed by four cross beams 30, each having a t-shaped cross section. The "palate" allows the rack to be engaged and lifted with the forks of a forklift truck (not shown).

The frame 12 further includes two opposing end assemblies 32. Each end assembly 32 comprises two corner posts 34, one center post 36, one upper cross rail 38 and one lower cross rail 40. A parts stand 42 is provided between the center post 36 and one of the corner posts 34 at each end of the rack 10. Each parts stand 42 comprises two runners 44 and four staggered end plates 46 for receiving and holding ends of the parts P in a manner that will be described in detail below.

A center beam 48, aligned with the center posts 36 and extending between the center posts and the upper cross rails 38 overlies the center rail 28. Four center posts 50 extend between the center rail 28 and center beam 48. The center posts 50 are centered on the rack 10 and overlie the "palate" formed by the cross beams 30.

Figure 1:
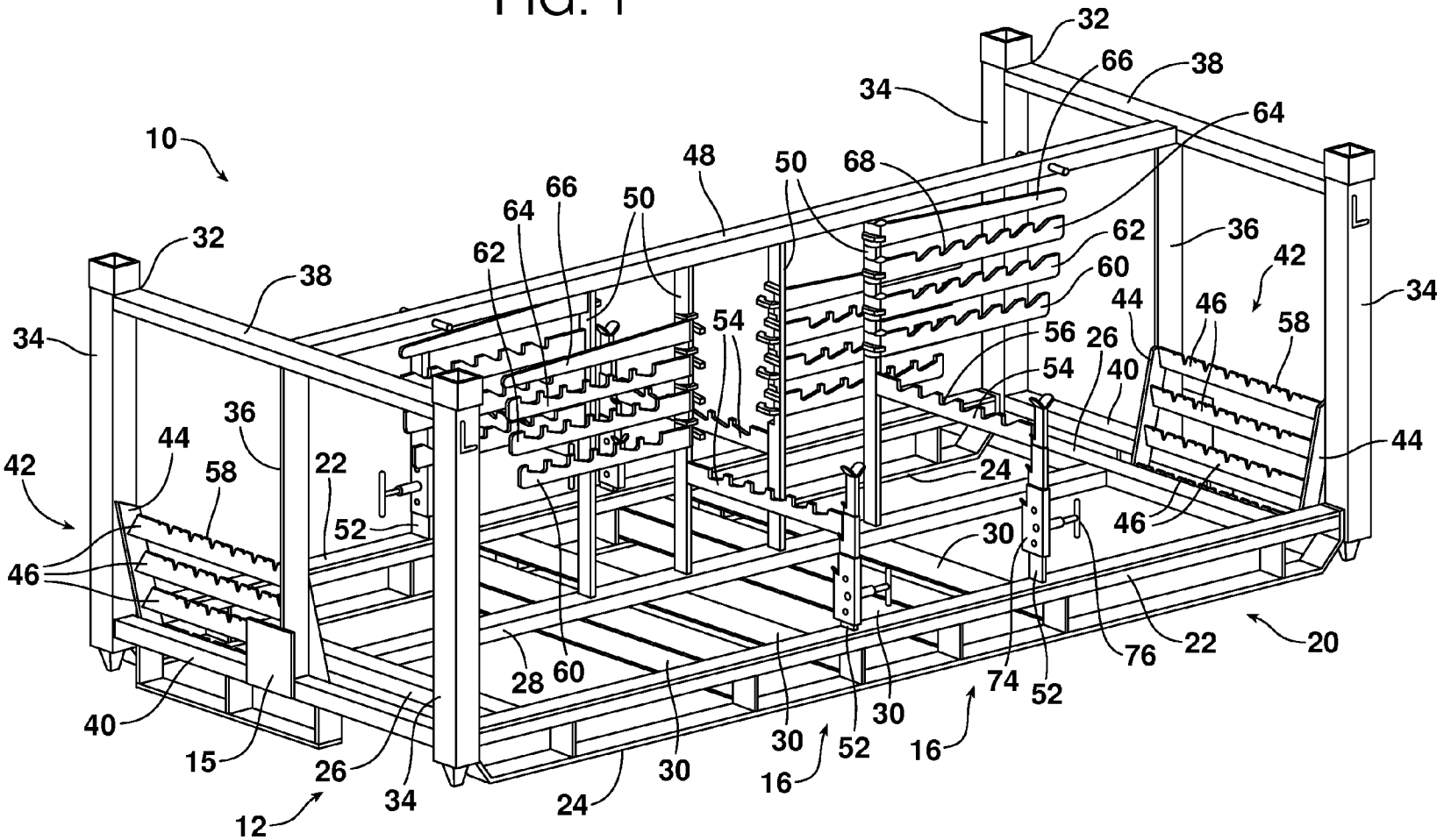
FIG. 1 is a perspective view illustrating an empty rack with the retaining arms and latching bars in the part loading position.

As further illustrated in FIG. 1, the frame 12 also includes four uprights 52. One upright 52 is provided aligned with each center post 50 with two of the uprights overlying each of the two side rails 22. A support arm 54 extends between each center post 50 and its cooperating, aligned upright 52. Thus each support arm 54 is fixed at one end to a center post 50 and at the other end to an upright 52.

As should be appreciated, each support arm 54 includes a plurality of part locating elements 56. In the illustrated embodiment the part locating elements 56 take the form of a plurality of spaced retaining grooves or scallops. Similarly, each plate 46 of the part stands 42 includes a plurality of part locating elements 58. In the illustrated embodiment the part locating elements 58 comprise spaced tabs.

Figure 3:
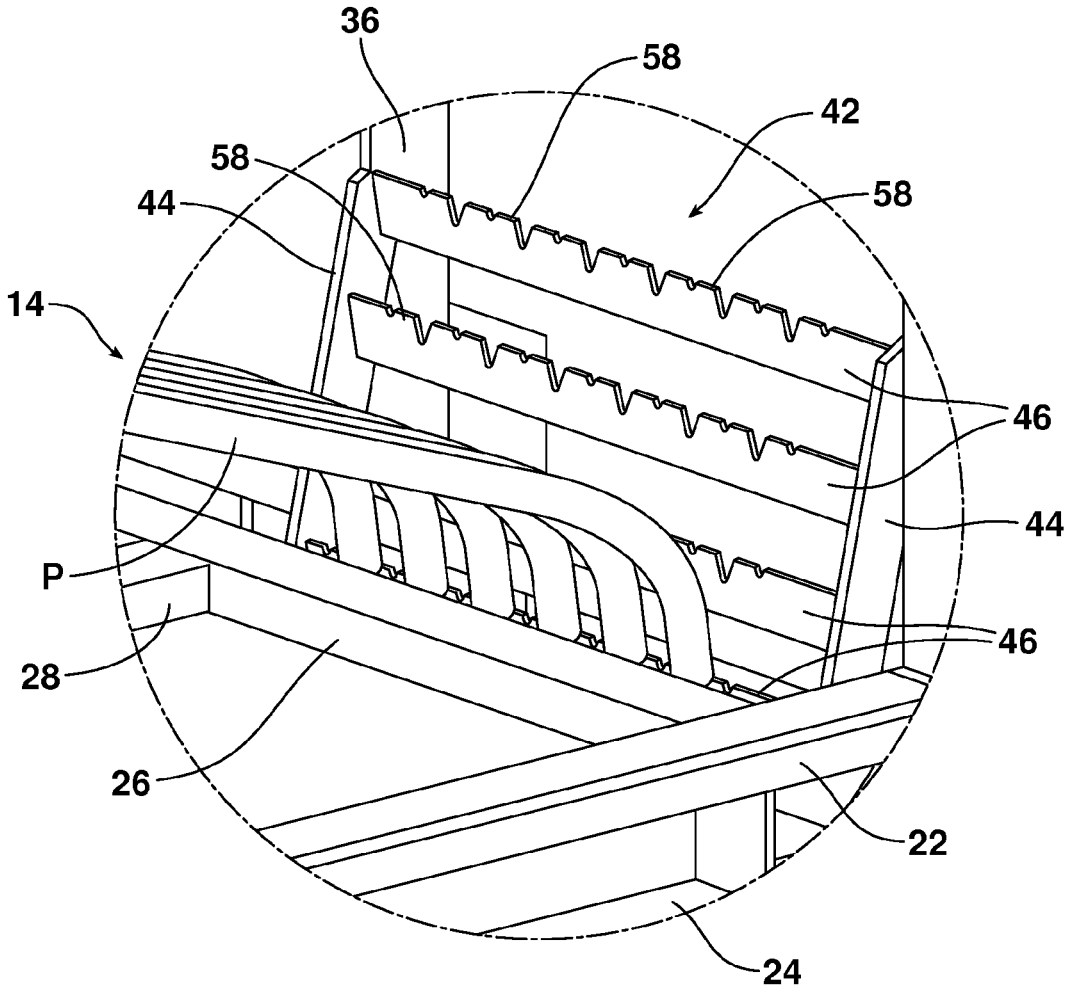
FIG. 3 is a detailed view illustrating how the open end of one part, in the illustrated embodiment a pillar and roof rail, is received on one of the tabs provided on a part locating endplate of the rack.
Figure 4:
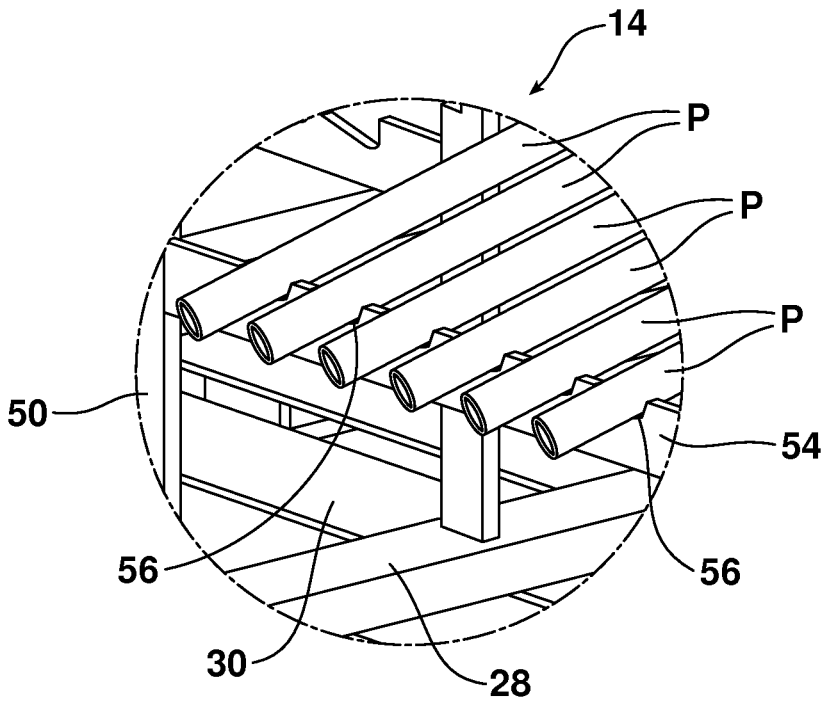
FIG. 4 is a detailed view illustrating how one of the parts rests in the slot, notch or groove on the support arm.

Reference is now made to FIGS. 2-4 illustrating how a part P is loaded into the rack 10. As illustrated, an opened end of the part or roof rail P is positioned over one of the tabs 58 of the lowermost, innermost parts stand plate 46. The body of the part P is then laid into the two aligned and cooperating part locating elements/grooves 56 in the first and second support arms 54. As should be appreciated, there are six tabs 58 on the lowermost, innermost parts stand plate 46 with each tab aligned with part locating elements/spaced retaining grooves 56 in the two support arms 54. Thus, the support arms 54 and the lowermost, innermost parts stand plate 46 hold individual parts P in six defined locations 14 across one side of the frame 10. It should be appreciated that six additional parts P are held in these structures on the opposite side of the rack 10 (i.e. other side of the center beam 48), to provide for balance.

Significantly, the tabs 58 receive and hold the open ends of the parts P so that they are directed downwardly. This promotes good, efficient drainage of the parts P during chemical pretreatment when they are removed from the treatment tanks 122 (see FIG. 13 and description that follows). As an advantageous consequence, less treatment solution is transferred between tanks 122.

Referring back to FIGS. 1 and 2, the rack 10 also includes four retaining arms 60, 62, 64, 66 pivotally connected to each center post 50. As should be appreciated, each retaining arm is selectively displaceable between a part loading position, illustrated in FIG. 1, and a part securing position illustrated in FIG. 6.

As illustrated, the lowermost arm 60 is slightly shorter than the next highest arm 62, which is slightly shorter than the next highest arm 64, which is slightly shorter than the longest, uppermost arm 66. Further, each of the three lowermost arms 60, 62, 64 include a plurality of part locating elements in the form of grooves or notches 68.

Figure 5:
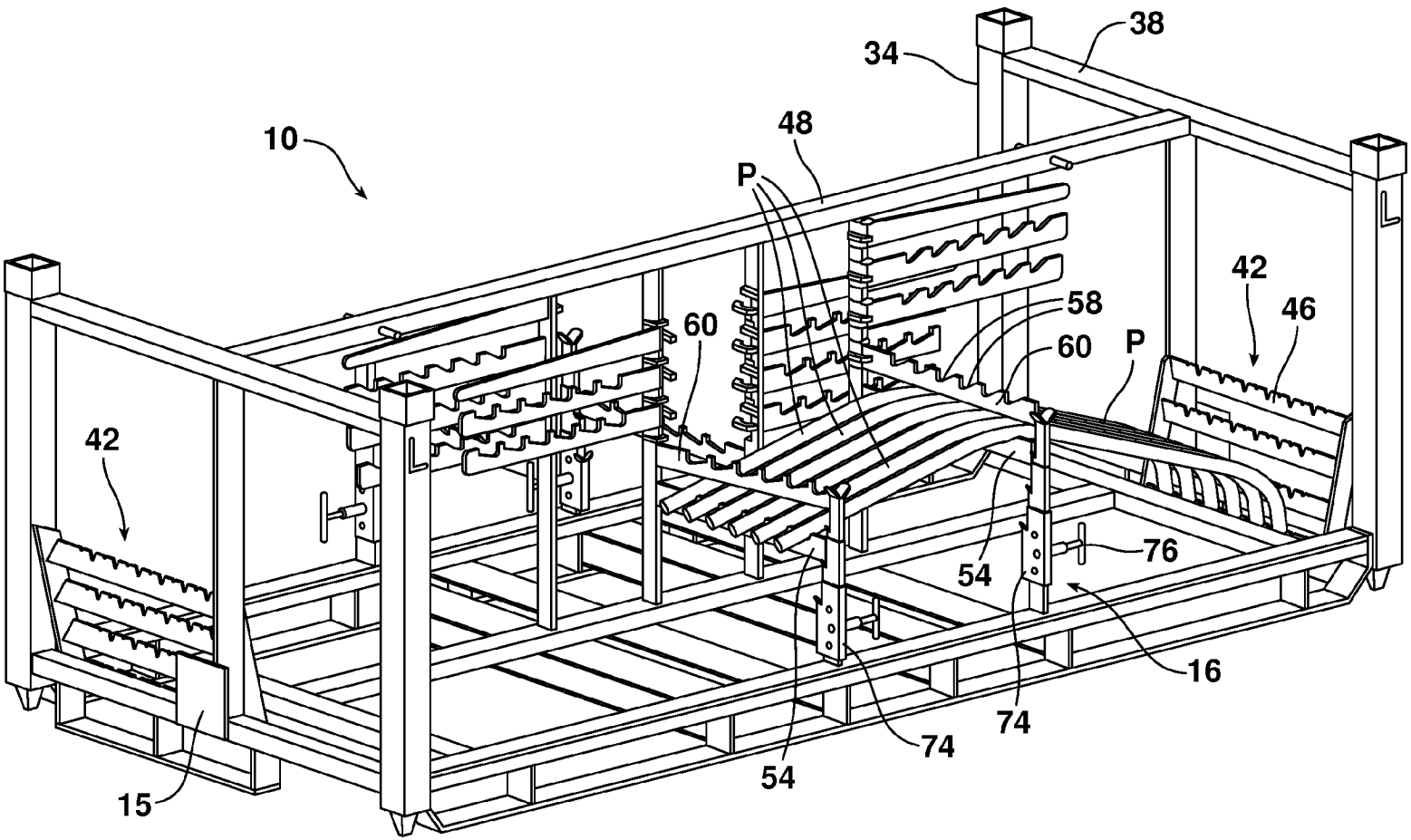
FIG. 5 is a perspective view similar to FIG. 2 showing the positioning of the two lowermost pivoting retaining arms in the part securing position so as to lie directly over the support arms supporting the first row of parts.

Once the first layer of six parts P has been positioned and located on the support arms 54 and the lowermost, innermost part stand plate 46 (as illustrated in FIG. 2), the lower most retaining arms 60 are pivoted from the part loading position illustrated in FIG. 2 to the part securing position illustrated in FIG. 5. In the part securing position, the retaining arms 60 overlie the support arms 54 and effectively capture the first row of parts P in the retaining grooves 56 thereby effectively locking those parts in their defined locations 14 on the rack. As should be appreciated, no single part P in the first row touches any other part. Thus, the parts P are fully exposed for whatever processing is desired while they are held in the rack 10.

The next row of parts P is now added to the rack 10. This is done by positioning the open ends of the next six parts on the six tabs 58 of the next highest, next innermost parts stand plate 46 and resting each part in the aligned retaining grooves 68 provided in the upper surface of the bottom most retaining arm 60. Once the six parts P of the next layer are positioned in this manner, the retaining arms 62 are pivoted from the part loading position to the part securing position. When in the part securing position the retaining arms 62 function to capture the second row of parts P in the retaining elements, grooves or notches 68 of the retaining arms 60.

Now a third row of parts P is added to each side of the rack 10. This is done by positioning the open ends of six parts P on the third parts stand plate 46 and resting the ends of the parts in the aligned cooperating parts retaining elements/grooves 68 in the retaining arms 62. Once all six parts P are properly positioned, the retaining arms 64 are pivoted from the parts receiving position to the parts retaining position. As should be appreciated, in the parts retaining position the retaining arms 64 overlie the parts in the third row thereby capturing the parts in the grooves 68 of the retaining arms 62. Thus the parts in the third row are maintained in defined locations on the frame 12 so that each individual part will not touch another part.

Now the final row of parts P is added to each side of the rack 10. To do this the open ends of six additional parts P are positioned over the tabs 58 in the uppermost parts stand plate 46 with the bodies of the parts received and resting in the aligned grooves 68 of the arms 64. When all six parts P of the fourth row of parts are properly positioned in their defined locations 14, the upper most retaining arms 66 are pivoted from the part loading position to the part securing position. As should be appreciated when the rack 10 is fully loaded and the retaining arms 60, 62, 64, 66 are all in the parts retaining position, all the retaining arms overlie the associated support arm 54 extending between the center post 50 to the cooperating, aligned upright 52. See FIG. 6.

As best illustrated in FIGS. 1, 2, 5 and 6, the latching assembly 16 includes a plurality of latching bars or slides 74. The latching bars 74 have a u-shaped cross section defining a longitudinal channel that will receive and capture the ends of the retaining arms 60, 62, 64, 66 when in the locking position.

One latching bar 74 is slidably received on each upright 52 and is displaceable between the part loading position and the part locking position. The part loading position is illustrated in FIGS. 1, 2, 5 and 6. In this position the latching bars 74 are fully retracted over the uprights 52. In contrast, as illustrated in FIGS. 7 and 8, when in the part locking position, the latching bars 74 are raised and fully extended from the uprights 52. As should be appreciated, each latching bar 74 includes a stepped configuration so that each latching bar will receive and capture the end of each retaining arm 60, 62, 64, 66 when in the locking position. See particularly FIG. 8 with parts P removed for clarity. A clevis pin 76 is provided to secure each latching bar 74 in the locking position. The clevis pin 76 is captured in the boss 87 welded to a side of each latching bar 74. See also FIG. 9. More specifically, the captive pin 76 is inserted through a cooperating aperture in the upright 52 supporting the latching bar. As should be appreciated, the end 78 of the captive pin extends completely through the latching bar 74. A security tab 80 extends through an aperture 82 in the end 78 of the clevis pin 76 and is secured in position (i.e. connected into a closed loop). In one possible embodiment the security tabs 80 are frangible and must be broken in order to be pulled from the clevis pin 76 to allow the clevis pin to be released for displacement of the latching bars 74 and the retaining arms 66, 64, 62, 60 for the removal of parts P from the rack 10. In one possible embodiment the security tab 80 is a permanently locking, sacrificial zip tie.

As should be appreciated, the retaining grooves 56, 68 and the tabs 58 provide a defined location 14 for each part P. The overlying retaining arms 60, 62, 64, 66 ensure that each part P is maintained in those defined locations 14 where no one part touches another part.

During chemical pretreatment, the rack 10 is dipped into a tank containing a chemical solution. Air is often trapped in individual parts P during dipping creating a buoyancy that tends to lift the parts P from the grooves 56, 68 and tabs 58. The overlying retaining arms 60, 62, 64, 66 function to maintain the parts P in the defined locations 14 within the grooves 56, 68 and on the tabs 58 so that the parts will receive the full benefit of the treatment.

An alternative method of racking such parts would be in a vertical orientation to aid drainage; however such a configuration requires deeper chemical tanks, a larger oven and a larger pretreatment system. Another alternative is to rotate the rack as it is dipped and raised i.e. horizontal within the tank to reduce tank size and chemical volume but pivoted to vertical on entry and exit to aid drainage. Such a line is more complex, costly and slower in operation. Horizontal with a trapped air pocket is also advantageous as the inner surface does not require pretreatment, thereby saving chemical consumption and minimizing "drag-out".

Reference is now made to FIGS. 10-12 illustrating an alternative embodiment of rack 82 for holding a plurality of parts illustrated as front rails F in defined locations. As illustrated in FIG. 10, the rack 82 includes a frame 84 which holds a first series of front rails F on each side of a centerline defined between the two top rails 86. As illustrated in FIGS. 11 and 12, a second, outer layer of front rails F is then loaded on each side of the rack 84. Once loaded the latching bars 88 are displaced from the rack loading position illustrated in FIG. 10 to the part locking position illustrated in FIGS. 11 and 12. Clevis pins 90 and security tabs 92 function to lock the latching bar 88 in the part locking position in the same manner as the latching bars 74 of the first embodiment described above. The parts are positioned to maximize packing density but orientated to maximize draining efficiency. This front rail required the parts to be rotated to prevent horizontal "dead spots".

Reference is now made to FIG. 13 which is a schematic block diagram of the floor 100 of the manufacturing plant. Block 102 in the drawing figure represents the rack loading area where the rack 10 is loaded with parts P in the manner described above. The loaded rack 10 is then delivered by forklift truck or other means from the rack loading area 102 to the heat treatment area generally designated by reference numeral 104. More specifically, the rack 10 is loaded onto a conveyor 106 which transports the rack 10 and the parts P locked therein through the heat treatment oven 108. Following heat treatment, that conveyor transfers the rack 10 and the parts P locked thereon to the conveyor 110. Conveyor 110 transports the rack 10 and parts P locked therein through the cooling chamber 112 thereby completing the heat treatment process.

A forklift or other means then transfers the rack 10 and the parts P locked therein to the chemical pretreatment area generally designated by reference numeral 114. More specifically, the fork lift truck delivers the rack 10 and the parts P locked therein to the loading area 116 where the racks are loaded onto a conveyor which, in the illustrated embodiment takes the form of a monorail 118. The racks 10 and the parts P locked therein are then transferred or transported by the monorail 118 through the chemical pretreatment facility 120. There the rack 10 and the parts P locked therein are dipped into the various treatment tanks 122 in order to complete the chemical pretreatment of the parts. The monorail 118 then delivers the racks 10 and the parts P held therein to the drying oven where the parts P and the rack 10 are dried before being delivered to the unloading station 126. A forklift truck or other means is then used to transfer or transport the racks 10 and the parts P locked therein to the assembly area 128 where the parts are removed from the rack and readied for vehicle assembly.

As should be appreciated, the parts P are locked into the rack 10 by means of the retaining arms 60, 62, 64, 66 and the latching assembly 16 including the latching bars 74 and clevis pin 76 at the rack loading area. The integrity of the processing of the parts P in the rack 10 through the heat treatment and chemical pretreatment process is ensured by the security tabs 80. More specifically, these security tabs 80 are inserted in the ends 78 of the clevis pins 76 and locked at the rack loading area 102 (before heat treatment). When the rack 10 reaches the assembly area 128, whole unbroken security tabs 80 indicate that all parts P in the rack 10 were properly subjected to heat treatment and chemical pretreatment. In contrast, if one of the frangible security tabs 80 is broken, that indicates the possibility that one or more parts P in the rack 10 did not undergo proper heat treatment or chemical pretreatment and, accordingly, the parts in that rack may be set aside for verification of proper heat treatment and chemical pretreatment processing where required. Thereby the security tab 80 ensures the integrity of the processing of the parts P. It should be noted that not all parts require the heat treatment step. For example, the roof rails that require high strength are heat treated post forming in order to artificially age the alloy and increase yield strength. Front rails are required to have lower yield and greater ductility to absorb energy in a frontal crash. For this reason, front rails are not heat treated and are therefore taken from the rack loading area 102, by fork truck, to the pretreated loading area 116. Such a configuration allows different alloys with differing heat treatment requirements to be processed through the same line.

In one particularly useful embodiment of the invention, each rack 10 includes a plate 15 bearing a unique ID code to identify the particular rack 10 (see FIGS. 1 and 12). This could be a bar code or other scannable image if desired. Further, monitors 130, 132, 134, 136, 138, 140 are provided at various locations on the floor 100 of the plant. Each monitor 130, 132, 134, 136, 138, 140 may include a video camera and/or a scanner. As illustrated in FIG. 13, one monitor 130 is provided at the rack loading area 102. Each part P loaded in the rack 10 may also have a specific, scannable ID number. Accordingly, the monitor 130 allows the recording of each individual part P loaded into a particular rack 10. The monitor 132 at the entrance to the heat treatment oven 108 records the time the particular rack enters the heat treatment oven 108. Monitor 134 at the exit to the cooling chamber 112 records the time when each particular rack 10 exits the cooling chamber 112. Monitor 136 records the time at which each particular rack 10 reaches the loading area 116 of the chemical pretreatment facility 114 while monitor 138 records the time when each particular rack is unloaded from the chemical pretreatment facility monorail 118. Finally, monitor 140 records the time when each rack 10 reaches the assembly area 128 and is unloaded. As each rack 10 has its own unique ID code and each part P held in each rack 10 is identified by its own ID number, the integrity of the heat treatment and chemical pretreatment processes may be monitored right down to the time the parts spend moving from the rack loading area 102 to the assembly area 128 including the specific time spent during heat treatment and chemical pretreatment. Of course, the heat treatment and chemical pretreatment processes are also monitored to ensure they are properly completed for each rack 10 of parts P. Such a process monitoring system on the floor of a manufacturing plant is disclosed in copending U.S. patent application Ser. No. 13/768,326, filed on Feb. 15, 2013 and entitled "Process Control For Post-Form Heat Treating Parts For An Assembly Operation", the full disclosure of which is incorporated herein by reference.

The foregoing has been presented for purposes of illustration and description. It is not intended to be exhaustive or to limit the embodiments to the precise form disclosed. Obvious modifications and variations are possible in light of the above teachings. All such modifications and variations are within the scope of the appended claims when interpreted in accordance with the breadth to which they are fairly, legally and equitably entitled.

What is claimed:

1. A rack for simultaneously processing a plurality of parts, comprising:

a frame;

a plurality of defined locations on said frame for receiving and holding individual parts for processing;

a latching assembly for locking said parts to said frame in said defined locations; and a security feature for indicating if said latching assembly is opened after said parts have been loaded and locked into said defined locations on said frame, wherein said frame including a first post, a first upright, a second post, a second upright, a first support arm and a second support arm wherein said first support arm extends between said first post and said first upright and said second support arm extends between said second post and said second upright, wherein said first support arm includes a first plurality of part locating elements and said second support arm includes a second plurality of part locating elements, wherein said first and second plurality of part locating elements comprise a plurality of spaced retaining grooves provided in said first and second support arms, wherein said frame further includes a first plate having a third plurality of part locating elements and wherein said third plurality of part locating elements comprise tabs received within open ends of said plurality of parts whereby said first, second and third locating elements locate a first group of parts in said defined locations on said frame so that no one part touches another part.

2. The rack of claim 1, wherein said frame includes a first retaining arm carried on said first post and displaceable between a part loading position and a part securing position.

3. The rack of claim 2, wherein said frame includes a second retaining arm carried on said second post and displaceable between a part loading position and a part securing position.

4. The rack of claim 3, wherein said first group of parts are captured in said defined locations (a) between said first retaining arm and said first support arm and (b) between said second retaining arm and said second support arm when said first and second retaining arms are in said part securing positions.

5. The rack of claim 4, wherein said first retaining arm includes a fourth plurality of locating elements and said second retaining arm includes a fifth plurality of locating elements.

6. The rack of claim 5, wherein said frame includes a second plate having a sixth plurality of locating elements whereby said fourth, fifth and sixth locating elements locate a second group of parts in said defined locations on said frame so that no one part touches another part.

7. The rack of claim 6, wherein said frame includes (a) a third retaining arm connected to said first post, (b) a fourth retaining arm connected to said second post, said third and fourth retaining arms both being displaceable between part loading and part securing positions and (c) a third plate.

8. The rack of claim 7, wherein said second group of parts are captured in said defined locations (a) between said third retaining arm and said first retaining arm and (b) between said fourth retaining arm and said second retaining arm when said third and fourth retaining arms are in said part securing positions.

9. The rack of claim 8, wherein said frame includes (a) a fifth retaining arm connected to said first post, (b) a sixth retaining arm connected to said second post, said fifth and sixth retaining arms both being displaceable between part loading and part securing positions, and (c) a fourth plate.

10. The rack of claim 9, wherein a third group of parts are captured between (a) said third and fifth retaining arms and (b) said fourth and sixth retaining arms when said fifth and sixth retaining arms are in said part securing positions.

11. The rack of claim 10, wherein said frame includes (a) a seventh retaining arm connected to said first post and (b) an eight retaining arm connected to said second post, said seventh and eighth retaining arms both being displaceable between part loading and part securing positions.

12. The rack of claim 11, wherein a fourth group of parts are captured between (a) said fifth and seventh retaining arms and (b) said sixth and eighth retaining arms when said seventh and eighth retaining arms are in said part securing positions.

13. The rack of claim 8, wherein said latching assembly includes a first latching bar and a second latching bar, said first latching bar engages and closes openings between said first support arm, said first retaining arm and said third retaining arm and said second latching bar engages and closes openings between said second support arm, said second retaining arm and said fourth retaining arm when said first and second latching bars are in said locking positions.

14. The rack of claim 13, wherein said latching assembly includes (a) a first clevis pin for securing a distal end of said first latching bar to said frame and (b) a second clevis pin for securing a distal end of said second latching bar to said frame.

15. The rack of claim 14, wherein said security feature includes (a) a first security tab connected to said first clevis pin so that said first clevis pin is captured in said frame by said first security tab and (b) a second security tab connected to said second clevis pin so that said second clevis pin is captured in said frame by said second security tab.

16. The rack of claim 15, wherein said first and second security tabs are frangible and must be broken to pull said first and second clevis pins from said frame and allow displacement of said first and second latching bars and first, second, third and fourth retaining arms and removal of any parts from said rack.

* * * * *